US011801420B2

(12) United States Patent
Crisp

(10) Patent No.: US 11,801,420 B2
(45) Date of Patent: Oct. 31, 2023

(54) TREADMILL DECK AND KIT

(71) Applicant: Charles Edward Delves Crisp, Cirencester (GB)

(72) Inventor: Charles Edward Delves Crisp, Cirencester (GB)

( * ) Notice: Subject to any disclaimer, the term of this patent is extended or adjusted under 35 U.S.C. 154(b) by 128 days.

(21) Appl. No.: 17/604,493

(22) PCT Filed: Apr. 20, 2020

(86) PCT No.: PCT/GB2020/050981
§ 371 (c)(1),
(2) Date: Oct. 18, 2021

(87) PCT Pub. No.: WO2020/212712
PCT Pub. Date: Oct. 22, 2020

(65) Prior Publication Data

US 2022/0212057 A1 Jul. 7, 2022

(30) Foreign Application Priority Data

Apr. 18, 2019 (GB) ..... 1905564

(51) Int. Cl.
*A63B 22/02* (2006.01)
*A63B 22/00* (2006.01)

(52) U.S. Cl.
CPC ..... *A63B 22/0285* (2013.01); *A63B 22/0015* (2013.01)

(58) Field of Classification Search
CPC ..... A63B 22/0015; A63B 22/0023; A63B 21/00047; A63B 22/02–2022/0278
See application file for complete search history.

(56) References Cited

U.S. PATENT DOCUMENTS 3,637,206 A * 1/1972 Chickering, III ..... A63B 22/02 482/54
4,204,673 A * 5/1980 Speer, Sr. ..... A63B 22/0292 601/40

(Continued)

FOREIGN PATENT DOCUMENTS

CN 206688096 U 12/2017
DE 202013004525 U1 5/2013

(Continued)

OTHER PUBLICATIONS

International Search Report and Written Opinion for Application PCT/GB2020/050981; dated Jul. 9, 2020; 12 pp.

(Continued)

*Primary Examiner* — Loan B Jimenez
*Assistant Examiner* — Kathleen M Fisk
(74) *Attorney, Agent, or Firm* — Armstrong Teasdale LLP

(57) ABSTRACT

There is provided a treadmill deck (10) for supporting at least part of a treadmill belt, the deck (10) including a foot strike area (12) disposed towards one end of the deck, and a foot take-off area (14) disposed towards another end of the deck, an upper surface of one of the areas (12, 14) including: a lateral inward or outward slope, which provides a lateral gradient across at least part of the area (12, 14), and an upper surface of the other of the areas (14, 12) including one of: a laterally horizontal surface or a lateral inward or outward slope, which provides a lateral gradient across at least part of that other area (14, 12).

19 Claims, 3 Drawing Sheets

(56) References Cited

U.S. PATENT DOCUMENTS

| | | | | |
|---|---|---|---|---|
| 4,772,014 | A * | 9/1988 | Rebman | A63B 69/0035 482/148 |
| 6,866,614 | B2 * | 3/2005 | Pan | A63B 22/0235 482/54 |
| 7,621,850 | B2 * | 11/2009 | Piaget | A63B 21/154 482/54 |
| 7,717,830 | B1 * | 5/2010 | Charniga | A63B 22/02 482/54 |
| 10,350,450 | B2 * | 7/2019 | Stelmach | A63B 22/0235 |
| 10,569,123 | B2 * | 2/2020 | Hochstrasser | A63B 24/0087 |
| 2003/0128186 | A1 | 7/2003 | Laker | |
| 2004/0192515 | A1 * | 9/2004 | Cane' | A63B 69/0035 482/54 |
| 2017/0197110 | A1 * | 7/2017 | Stelmach | A63B 69/0057 |
| 2018/0154207 | A1 * | 6/2018 | Hochstrasser | A63B 22/025 |

FOREIGN PATENT DOCUMENTS

| | | | |
|---|---|---|---|
| WO | 2012150781 | A2 | 11/2012 |
| WO | 2014137221 | A1 | 9/2014 |

OTHER PUBLICATIONS

International Preliminary Report on Patentability for Application PCT/GB2020/050981 dated Apr. 6, 2021; 5 pp.
Combined Search and Examination Report for Application GB1905564.9; dated Sep. 25, 2019; 9 pp.

* cited by examiner

TREADMILL DECK AND KIT

CROSS-REFERENCE TO RELATED APPLICATIONS

This application is a U.S. National Phase Application of PCT/GB2020/050981, filed Apr. 20, 2020, which claims the benefit of priority to GB Application No. 1905564.9, filed Apr. 18, 2019, the contents of which are hereby expressly incorporated by reference in their entirety.

FIELD OF THE INVENTION

The present invention relates to a treadmill deck for supporting a treadmill belt, and to a kit comprising a retrofittable treadmill deck for replacing or modifying an existing treadmill deck in a treadmill.

BACKGROUND TO THE INVENTION

Different people have different postures whilst walking. In general, there is often an postural imbalance or deficiency of some sort. Imbalanced posture can result from weaknesses in certain muscles or another issue in the feet (such as in the arches), legs, hips or elsewhere, or as a result of an injury, amongst other things. Postural imbalance can result in joint pain or back pain, for example, as some parts of the body are used to compensate for issues in other parts.

Compensating for a postural imbalance whilst walking or running may be painful or cause undue stress to certain muscles, potentially leading to or exacerbating an injury. Over time, the effects may be seen as uneven wear on a shoe sole, for example. However, incremental damage to tissues or joints can be more difficult to identify at an early stage, and so measures to limit or reverse such damage may not be taken.

Walking or running rehabilitation exercises can be used to correct or improve posture or balance. The particular exercises used depend on the physical ability of the person being treated, and the severity of the postural defect. Learning to adopt a corrected posture takes time and a protracted period of rehabilitation may be needed. Even then, conventional rehabilitation exercises do not always successfully resolve the imbalance or pain resulting from it.

It is an object of the present invention to reduce or substantially obviate the aforementioned problems.

STATEMENT OF INVENTION

According to a first aspect of the present invention, there is provided a treadmill deck (or deck unit) for supporting at least part of a treadmill belt.

The treadmill deck is constructed to adjust the angle of the or each foot during the gait cycle for improving or correcting posture. The deck can be shaped for correcting different postural weaknesses during use. The deck may be considered to provide an uneven or sloped surface for promoting use of muscles which are normally utilised less (or not much at all) when walking on a flat surface.

The deck is designed to fit under the belt of the treadmill. It helps to exaggerate and/or challenge the natural walking gait movements of a person throughout the entire kinetic chain, improving overall mobility. The shapes of the upper surface of the deck challenges the arches in the foot during both suspension and propulsion stages. It encourages and/or challenges the rolling motion of the hips to engage lazy muscles around the hips, spine and potentially shoulders too. It also strengthens or stretches certain muscle groups in the lower leg.

The deck is surprisingly effective even after only short periods of usage, indicating that the degree of postural correction or related ailments (including rate of obtaining a positive outcome, and/or quality of the outcome, including the length of time the positive outcome lasted for) is substantially improved relative to conventional techniques. A positive outcome includes improved posture and/or reduction or elimination of pain related to postural imbalance.

From testing, use of a treadmill comprising the deck eradicated knee pain in one user, who had previously experienced when walking down a steep hill. Pain-free movement lasted for three days from only ten minutes of walking on the treadmill. Hip pain was relieved for a second user. A feeling of youthfulness was described by a third user when starting a sporting activity after walking on the treadmill.

References to features which include the front/rear end, for example, should be construed in accordance with the expected position of the treadmill deck once installed in or on a treadmill.

The treadmill deck may be considered to be a board for correcting posture. The upper surface may be considered to provide a template for walking on, or to provide a surface for engaging the underside of the treadmill belt during use. The upper surface may be a substantially fixed surface. The upper surface may be substantially continuous across the width and/or along the length of the deck.

The treadmill deck may be considered to be a treadmill belt support. That is, a surface or substructure for positioning under a treadmill belt. The deck may be provided as an integral part of a treadmill, or may be retrofitted to a treadmill. The deck may therefore be considered as a deck extension for an existing treadmill deck, where the extension is in an upwards direction.

The term foot strike area means an area of the deck intended for a foot to contact or land when a person is walking or running. The term foot take-off area means an area of the deck intended for a foot to propel off when a person is walking or running.

The term lateral slope (or transverse slope) means that there is a slope providing a change in height across some or all of the relevant part of the deck. This is considered relative to the horizontal when the deck is laid down on a flat and level surface. It may also be considered relative to the base (of part of the base) of the deck, if the base is substantially planar for example. The slope should be suitable for walking on.

In the deck, the slope direction is considered relative to whether a left foot or a right foot will be engaged with that portion.

For a region for use by a left foot, an outward slope (particularly a lateral outward slope) is a slope which decreases in height from right to left, when viewed from the rear end of the deck along a longitudinal axis of the deck. For a region for use by a right foot, an outward slope is a slope which decreases in height from left to right, when viewed from the rear end of the deck along a longitudinal axis of the deck when upright. An example of an upright orientation is seen in FIG. 10, for example.

For a region for use by a left foot, an inward slope (particularly a lateral inward slope) is a slope which decreases in height from left to right, when viewed from the rear end of the deck along a longitudinal axis of the deck. For a region for use by a right foot, an inward slope is a slope which decreases in height from right to left, when viewed from the rear end of the deck along a longitudinal axis of the deck when upright.

The term lateral gradient means that the relevant area or section is at an angle relative to the horizontal. This is when viewed along a longitudinal axis of the deck when upright. In other words, when viewed from one of the ends. For the avoidance of doubt, a lateral gradient may be present when the deck is in a normal use position. The normal use position may be where the deck is substantially horizontal (or in some cases pitched upwards or downwards by a particular angle) with the foot strike and take off areas facing upwards. That is, in the orientation expected for use in a treadmill.

The term laterally horizontal surface means that there is a gradient of zero degrees in that portion of the upper surface of the deck, when viewed along a longitudinal axis of the deck, with the deck upright. The laterally horizontal surface may be considered as a (laterally) flat slope, for consistency with the 'inward slope' and 'outward slope' terminology.

The term longitudinal gradient means that the relevant area or section is at an angle relative to the horizontal when viewed along a lateral axis of the deck when upright. In other words, when viewed from the side.

An inward slope may be provided in only one of the foot strike and take-off areas. In this case, the other of the foot strike and take-off areas may have a laterally horizontal surface or a lateral outward slope.

An outward slope may be provided in only one of the foot strike and take-off areas. In this case, the other of the foot strike and take-off areas may have a laterally horizontal surface or a lateral inward slope.

The lateral gradient across the strike area may slope or curve one way and, if not laterally horizontal, the lateral gradient across the take-off area may slope or curve the other way. That is, for strike and take-off areas arranged on a longitudinal axis, the lateral gradients may have opposite signs (one positive, one negative).

The foot strike area can have a different or opposing gradient to that of the foot take-off area, where only one of those areas has an outward slope, and/or only one of those areas has an inward slope.

The upper surface of the foot strike area may include a longitudinal slope. The upper surface of the foot take-off area may include a longitudinal slope.

This can provide a longitudinal gradient along at least part of the relevant area(s). Respective longitudinal and lateral slopes in a particular part of the deck are preferably provided as part of the same slope having both lateral and longitudinal gradients. This means that the deck surface is sloped in two dimensions relative to the horizontal.

The longitudinal gradient may be provided at an incline of substantially up to about 20% (or even up to 40%). This can be done by adjusting a treadmill incline angle, which changes the angle of the deck relative to the ground. Preferably, the incline is up to about 15%. More preferably, the incline is in the range about 5% to 15%, or in the range about 10% to 15%. This provides an uphill gradient. The deck itself may be shaped to include the necessary uphill slope, for example having the upper surface of the deck arranged at an angle relative to the base of the deck. Alternatively, the treadmill may include means which provides the deck at the desired longitudinal gradient. The incline is taken relative to the horizontal.

Note that, if the deck is provided at an incline when installed in the treadmill, consideration of the meanings of each slope should be considered in light of the angle at which deck is disposed, which may include the angle of the base of the deck (or a plane of the base) to the horizontal.

The uphill gradient can encourage a more mid-foot landing or strike, compared to a normal heel strike when walking on flat ground. It is believed that the mid-foot landing, particularly on an outward slope, increases eccentric supination of the foot and eccentric plantar flexion that both occur simultaneously during the mid-stance phase of walking or running.

The magnitude of the lateral gradient of the foot strike area may decrease from the near end of the deck (that is, the front end) towards the foot take-off area. In other words, the steepness of the sideways slope may decrease moving from the front of the foot strike area to the rear of the foot strike area.

The magnitude of the lateral gradient of the foot take-off area may decrease from the near end of the deck (that is, the rear end) towards the foot strike area. In other words, the steepness of the sideways slope may decrease moving from the rear of the foot take-off area to the front of the foot take-off area.

Preferably, the or each lateral inward or outward slope has a substantially constant lateral gradient. However, one or more of the lateral and/or longitudinal slopes may be curved. Some or all of the lateral and/or longitudinal slopes may be curved. In other words, the lateral gradient may increase (or decrease) with towards one side of the deck. The longitudinal gradient may increase (or decrease) towards the respective end of the deck. Where provided, the curved portion(s) are concave in profile.

The foot take-off area may be longitudinally in-line with the foot strike area.

The foot strike area may be connected to or spaced from the foot take-off area by a substantially horizontal region, area, or inflection of the deck. This can provide a smooth transition between the foot strike and take-off areas or zones. The inflection may be considered as part of the upper surface where the rate of change of lateral gradient is zero. The inflection may be considered as a horizontal region whose length along the deck is substantially zero.

The foot strike area may transition into the horizontal area or inflection in a region disposed in the front half of the deck. That is, the transition may be disposed to one side of a lateral midline of the deck.

This can provide a longitudinally shorter foot strike area than foot take-off area. This is preferred when the treadmill deck is to be used for running. It also means the deck can be adapted for people with different stride lengths.

Where left and right portions are provided, the transition or inflection may be provided at different regions for the left and right sides. This may be appropriate for treating severe injuries or for use by a person with cerebral palsy, for example.

During use, the treadmill belt may pass over the deck from the strike area to the take-off area. That is, the upper surface of the belt moves backwards, such that the user must step forwards to remain on the treadmill.

The foot strike area may include an inward slope. The foot take-off area may include a laterally horizontal surface or an outward slope.

During use, the heel may strike on an inwardly slanted surface and may then propel off an outwardly slanted surface. This can exaggerate the natural three-dimensional gait movement and engage particular muscles, especially around the hips and lower back in a relaxed manner. It also challenges the balance of the walker and improves core strength over time, as the body gets used to the articulation.

In some cases, during use the heel may strike on an inward slant and may then propel off a laterally horizontal (or flat) surface. This may encourage internal rotation of the hip during the strike phase of a walking or running gait in a relaxed manner. This may also or alternatively encourage a stretch in the lateral longitudinal arch. This can be useful for an individual with a more severe postural defect, or for an individual with an injury that require gentle manipulation for rehabilitation.

The foot strike area may include an outward slope. The foot take-off area may include a laterally horizontal surface or an inward slope. Having an outward slope in one area and an inward slope in the other area is one of the most preferred versions (optionally where the deck has right and left portions, providing a V shape in one area and an inverted V shape in the other area).

If during use the heel strikes on an outwardly slanted surface and then propels off an inwardly slanted surface, this can challenge the muscles in the lower leg which may in turn address foot arch dysfunction or abnormality.

When the heel strikes on a gentle outwardly angled slope, the dorsiflexion of the ankle is immediately challenged. This can abnormally stretch the plantar flexors of the ankle in a dynamic fashion. The landing (or strike) area of the deck assists with a high and/or stiff arch with a positive knock-on effect up the entire kinetic chain. As the foot transitions towards the back of the deck, the twist in the deck gently manipulates the foot to an inward slope.

When stepping forward, the natural motion of the foot is to propel outward using inversion, laterally rotating the hip. The inward slope of the foot take-off area can challenge the plantar flexors and invertors of the ankle, so that they are strengthened and lift the arch. The shape of the rear (take-off) section of the deck can improve arches that are initially flatter or weaker than ideal, and/or may encourage a greater range of movement for those with a stiffer arch.

Put another way, during the propulsion (the toe-off phase), the inward slope increases the eccentric load on both of the plantar fascia, which are involved in the Hicks Windlass mechanism, and the evertors of the ankle, which primes the supination action involved in propulsion of the gait cycle. Once these muscle groups are working through a greater and more stable range of dynamic movement as a result of walking the outward slope and propelling off the inward slope, the range of movement will be greater through the complete kinetic chain when subsequently walking on a normal flat surface. This provides the walker with a much "freer" feeling.

If during use the heel strikes on an outwardly slanted surface and then propels off a flat surface, this can challenge the medial longitudinal arch in a dynamic strengthening manner. It may be beneficial for high stiff arches as it would stretch the muscles responsible for suspension. This can be useful for an individual with a more severe postural defect, or for an individual with an injury that require gentle manipulation for rehabilitation.

The foot strike area may include a laterally horizontal surface. The foot take-off area may include an inward slope or an outward slope.

If during use the heel strikes on a laterally horizontal (or flat) surface and then propels off an inward slant, this can challenge the muscles involved in propulsion in a dynamic strengthening manner. If during use the heel strikes on a laterally horizontal (or flat) surface and then propels off an outward slant, this can encourage external rotation of the hip during propulsion in a relaxed manner. Both of these options can be useful for an individual with a more severe postural defect, or for an individual with an injury that require gentle manipulation for rehabilitation.

The foot strike and take-off areas may both include inward slopes or outward slopes. One or both of the foot strike and take-off areas may include longitudinal slopes in a similar manner to described above.

The foot strike and take-off areas may provide a twisted surface along the deck for walking or running on. The twisted surface may extend substantially from one end of the deck to the other. This can provide a wave-like surface in the deck. The or each twisted surface may include a twist relative to a longitudinal axis (or respective longitudinal axes) disposed above the upper surface of the deck.

When considered from above, each twisted surface may be considered to include four corners of a rectangle. In some cases, two opposing corners will be disposed higher than the other two opposing corners, providing a twist between the strike and take-off regions. In some cases, the corners in one of the strike or take-off areas are at different heights, and the corners in the other of the strike and take-off areas are at the same or similar heights. This still provides a twist between the strike and take-off regions, but it is less pronounced.

The laterally horizontal surface (or inflection) may be disposed at a middle of the deck or between the middle and rear of the deck.

The deck may include left and right halves (or regions) for left and right feet.

The deck may include at least first and second discrete bodies for left and right feet. If two elongate bodies are provided they may be substantially the same length and width. The bodies may be positioned or secured next to each other to form the deck. Alternatively, if discrete strike and take-off sections are provided, the bodies may be spaced apart by a distance when installed, with another body providing support for the treadmill belt across that distance. It is also contemplated that three or four, or more, sections or bodies may be provided and arranged together to provide the deck.

In the event that only one of the left or right bodies is provided, then another body (for example, the existing structure under a treadmill belt) may support the rest of the belt.

The left foot strike and take-off areas may be longitudinally in-line with each other. The right foot strike and take-off areas may be longitudinally in-line with each other.

The deck may only include a right portion with strike and take-off areas for the right foot. The deck may only include a left portion with strike and take-off areas for a left foot. Another deck portion or unit may be provided for use adjacent to the left or right-only portion, for supporting the treadmill belt. The other deck portion may be substantially flat or planar. The other deck portion may be integrally formed with the first (left-only or right-only) deck portion, or may be a discrete body.

The foot strike area may include a left portion. The foot strike area may include a right portion. The foot take-off area may include a left portion. The foot take-off area may include a right portion. Any suitable combination of foot strike and take-off portions may be provided.

The left and right portions of the foot strike area may have opposing lateral gradients. The left and right portions of the foot take-off area may have opposing lateral gradients. In other words, if the left (or right) portion includes an outward slope, then the right (or left) portion includes an outward slope. The magnitudes and/or rate of change of each lateral gradients in each of the left and right portions may be the same or may differ.

The left and right portions of the foot strike or take-off area may together provide a substantially convex or inverted V-shaped surface. The inverted V-shaped surface may be considered to be a mountain-shaped surface. The inverted V may be arranged along a central longitudinal axis of the deck.

The left and right portions of the foot take-off or strike area may together provide a substantially concave or V-shaped surface. The V-shaped surface may be considered to be a valley-shaped surface. The V may be arranged along a central longitudinal axis of the deck.

In embodiments with a valley in one area and an inverted V in the other area, the magnitudes of the lateral gradients of the deck may be equal but opposite. That is, the outward slope of one area may be sloped at the same angle to the inward slope of the other area, but with opposite sign.

The twisted surface may be twisted along some or all of the length of the deck. Where a laterally horizontal area or surface is provided in one of the strike or take-off areas, the twisted surface on that side may emerge out of, or transition into, that laterally horizontal portion.

The foot strike and/or take-off areas may provide twisted surfaces along each of the left and right halves of the deck. The twisted surfaces on the left and right halves may have opposing senses of rotation.

The deck may be substantially symmetric about a central vertical longitudinal plane through the deck. Equal and opposite lateral gradients may be provided in the foot strike area. Equal and opposite lateral gradients may be provided in the foot take-off area. Alternatively, different custom gradients may be provided for each of the left and right sides of the relevant area(s), such that the deck is asymmetric about the central vertical longitudinal plane.

Deck thickness in the foot strike area may be thicker or thinner in the middle of the deck than towards opposing lateral sides of the deck. Deck thickness in the foot take-off area may be thicker or thinner in the middle of the deck than towards opposing lateral sides of the deck.

Deck adjustment means may be provided for adjusting the shape or angle of one or both of the foot strike and foot take-off areas. The deck adjustment means may be configured to adjust either or both of the left and right portions of the foot strike and take-off areas. This may allow the deck to interconvert between different configurations of inward and outward slopes, and/or allow use of a range of lateral and/or longitudinal gradients.

A flexible or modular deck may be provided for use with the deck adjustment means. For example, the deck may include one or more parts that can be moved relative to neighbouring parts. The deck adjustment means may include one or more actuators which can adjust the vertical height of the one or more parts of the deck. The slopes of the upper surfaces of the parts may be adjustable to provide a smooth surface. That is, a surface that is substantially contiguous so as not to tear or damage a treadmill belt.

Where provided, the left and right portions of the deck may be independently moved via the adjustment means, or they may be adjusted by equivalent amounts. A controller with one or more pre-programmed deck configurations may be provided for easily configuring the deck for a particular user. For example, there may be one or more buttons for easily configuring the deck as desired.

The deck may include a minimum height difference between the lowest and highest points of the upper surface of deck. In other words, the deck may have a minimum thickness, for example 10 mm. The foot strike area and/or foot take-off area may have a maximum or minimum height which is higher or lower than the minimum thickness of the deck.

The minimum height difference for points on the deck surface may be assessed relative to a plane at the base of the deck, for example when the deck is in a horizontal use position. The minimum height difference for high and low points on the deck surface may also be assessed considering the distance between parallel horizontal planes positioned to meet the highest and lowest points on the upper surface of the deck, for example when the deck is in a horizontal use position.

The minimum height difference may be independently selected from the following group: 5 mm, 7.5 mm, 10 mm, 12.5 mm, 15 mm, 17.5 mm, 20 mm, 22.5 mm, or 25 mm. This allows the deck to be more suitable for walking, jogging or running. Selecting a deck with, inter alia, a particular minimum height difference can also accommodate the stride length, gait, speed of travel, height and/or medical condition of a particular user.

The highest and/or lowest points of the deck may be inset from a longitudinal edge of the upper surface. The highest and/or lowest points of the deck may be inset from a lateral edge of the upper surface. The highest and/or lowest points of the deck may be rounded.

The angle of each lateral slope may be up to about ±15 degrees from the horizontal. This is when the deck is viewed in cross-section from the front or rear ends, i.e. along a longitudinal axis of the deck. The angle of each lateral slope in the middle of the strike or take-off areas may be up to about ±5 or ±10 degrees from the horizontal. It is more likely that the middle of the area will be stepped on or kicked off from during use. Preferably, the angle of each lateral slope is in the range about ±3 to ±8 degrees from the horizontal.

The lateral slope may be at zero degrees to the horizontal if a laterally horizontal surface is provided in the relevant strike or take-off area. The angle of each lateral slope may gradually approach zero towards a middle section of the deck.

The minimum angle of each lateral slope may be about ±0.5 or ±1.5 or ±3 degrees from the horizontal.

It is also contemplated that the gradient can be selected according to whether the deck is for walking or running on. For example, in the case where there is an outward strike slope and an inward take-off slope, the lateral gradients have a lower magnitude in a deck for running, as opposed to a deck for walking. This is the because pronation and supination of the foot is reduced when running, compared to walking. A lower minimum height difference may be preferred for a running deck. This may provide a lower angle of each lateral slope, for example up to about ±15 degrees from the horizontal.

The foot strike area may be less than half the length of the deck. The foot take-off area may be more than half the length of the deck. This accounts for the different gait used when running, by providing the centre point closer to the front end. During use, initial contact of the foot is naturally more directly underneath the person when running, as opposed to walking. The position of the transition between strike and take-off areas accommodates this. Even so, the foot is still in contact with the ground behind the runner for a similar length of time to walking gait. When running, the impact on the feet is much greater and provides improved retraining of weak or impaired muscles, for an athlete, for example.

The front and/or rear ends and/or sides of the deck may be rounded for use with the treadmill belt. The region where lateral gradients in the left and right sides of the deck meet may be rounded. In other words, a watershed region, where two slopes slope away in different directions, may be rounded. This reduces wear on the belt.

The deck may include (or be treated with) a lubricant or coating for reducing friction with the treadmill belt. The lubricant may be an oil. The oil may be silicon oil.

The deck may include a base. The base may include a grippy or tacky surface or coating. For example, the surface may include a rubbery or rubber-like material, or another material such as silicone (in a form which increase grip, not as a lubricant). That is, the underside of the deck may be adapted to have a high coefficient of friction with another surface it engages during use. The grippy surface allows the deck to maintain its position under a treadmill belt via friction, without the need for dedicated fixings such as bolts or screws, aided by pressure from the treadmill belt. This is preferable because it avoids damaging the treadmill, and allows ready removal or interchange of the deck with another deck.

For example, the engaged surface may include a treadmill deck which is already installed in the treadmill. The present invention can be installed between that pre-existing deck and the treadmill belt, with the grippy surface engaging the pre-existing treadmill deck and the upper surface engaging the treadmill belt.

The treadmill deck may be provided in the form of a unitary body or single piece. This simplifies retrofit of the deck to a treadmill, making installation possible in a matter of seconds in some cases.

According to a second aspect of the present invention, there is provided a treadmill deck (or deck unit) for supporting at least part of a treadmill belt.

The advantages are similar to the first aspect of the invention. Here, the strike (or take-off) area is for both feet, with lateral gradients in both left and right halves. The deck or unit can be installed under a front portion or rear portion of a treadmill belt, according to whether foot strike or foot take off is being modulated. The deck or unit may taper or be shaped such that it blends into the existing deck or sub-belt portion. That is, where only a front or rear section of the belt is supported by the invention, it may smoothly converge with the rest of the belt supporting area. However, this blending is optional. A flat portion of deck (e.g. 10 mm in thickness) which serves as a base for the sloped portions may provide the required strike or take-off area without the need to blend fully into the surrounding deck (if retrofitted to an existing treadmill, for example).

The second aspect of the invention may include any one or more features presented with the respect to the first aspect of the invention. For example, the deck may include both foot strike and foot take-off areas. The deck may include front and rear halves or sections, which together provide a treadmill deck for supporting most or all of a treadmill belt.

In the event that only one of the front or rear bodies is provided, then another body (for example, the existing structure under a treadmill belt) may support the rest of the belt. The front/rear body may taper or reduce in thickness at one end for gradually blending into that other support.

According to a third aspect of the invention, there is provided a treadmill deck (or deck unit) for supporting at least part of a treadmill belt. Advantages are similar to the first aspect of the invention.

According to a fourth aspect of the invention, there is provided a kit for replacing or modifying an existing treadmill deck in a treadmill. The advantages are similar to the first aspect of the invention.

According to a fifth aspect of the invention, there is provided a kit for replacing or modifying an existing treadmill deck in a treadmill. The advantages are similar to the second aspect of the invention.

Either of the fourth and fifth aspects may include any feature or features from the first to third aspects of the invention.

Providing a kit has the particular advantage that an existing treadmill can be modified to include a retrofittable deck. The deck may replace or be installed on top of a deck which is already present in the treadmill. This allows easy conversion of a conventional treadmill from having a flat deck to having a posture-correcting or posture-improving configuration, for example. In a clinical setting, it also enables easy interconversion between different posture-correcting or posture-improving configurations by fitting different treadmill decks, such as those described in the detailed description below.

According to a sixth aspect of the invention, there is provided postural correction board (or surface) for walking on.

According to a seventh aspect of the invention, there is provided a treadmill comprising a treadmill deck, kit or board according to any of the previous aspects of the invention.

The deck can be provided under the treadmill belt. The belt runs over the top of the deck during use. If the deck is a full-sized deck, for supporting substantially all of the belt, then the deck of the present invention may be installed from the start, optionally after removing a pre-existing installed deck. Alternatively, the deck of the present invention may be installed on top of the existing deck.

If the deck is not as wide as the treadmill belt, and/or not as long as the treadmill belt, then it can still be installed. In this case, the deck (or deck unit) of the present invention is installed to support part of the treadmill belt. The existing deck then provides support for the remainder of the belt. In this instance, the deck may taper or become thinner towards one side or two adjacent sides, for smoothly blending into the existing deck. However, during testing, there have not been any issues with using a deck or unit that is smaller than the total upper surface area of the belt.

According to another aspect of the invention, there is provided an exercise board comprising a body, a flat base on one side of the body for positioning against a flat substantially horizontal surface, and a foot strike and take-off area on the opposite side of the body to the base, the foot strike and take-off area including left and right regions for left and right feet, the left region including a lateral inward or outward slope which provides a lateral gradient across at least part of the left region, and the right region including a lateral inward or outward slope which provides a lateral gradient across at least part of the right region.

The device may be considered to be a postural correction board, or a postural optimisation board. An athlete can use the device during their warm-up routine. For example, they can jump up and down on it whilst skipping, or they can jog on the spot on it, for example. This is useful to prepare the lower extremities for competition. The device is ideally small enough to be portable. The board may be wider than it is long.

Preferably both lateral slopes are inward or outward slopes. In other words, they preferably have opposite slope directions. This provides a V-shaped or inverted V-shaped surface for standing or jumping on.

The slopes may be curved or may have constant gradients. There may be a longitudinal gradient on either or both sides, in addition to the lateral gradients. If provided on both sides, the longitudinal gradients (or the longitudinal components of the slopes) may be substantially parallel. For example, both longitudinal slopes may provide an 'uphill' slope (thickness of the board greater at the toes during use), or both longitudinal slopes may provide a 'downhill' slope (thickness of the board greater at the heel during use).

In some cases, the exercise board includes foot strike and take-off areas like the treadmill deck aspects of the invention. The board can therefore include both V-shaped and inverted V-shaped areas for training. An athlete may walk along the deck repeatedly to stretch muscles in their feet and legs, for example. The board may be lightweight for portability. This allows the board to be easily transported for use on its own or with a treadmill at another location.

Any aspect of the invention may include any features or features presented with respect to any of the other aspects of the invention.

BRIEF DESCRIPTION OF THE DRAWINGS

For a better understanding of the present invention, and to show more clearly how it may be carried into effect, reference will now be made by way of example only to the accompanying drawings, in which.

DESCRIPTION OF PREFERRED EMBODIMENTS

Figure 1A:
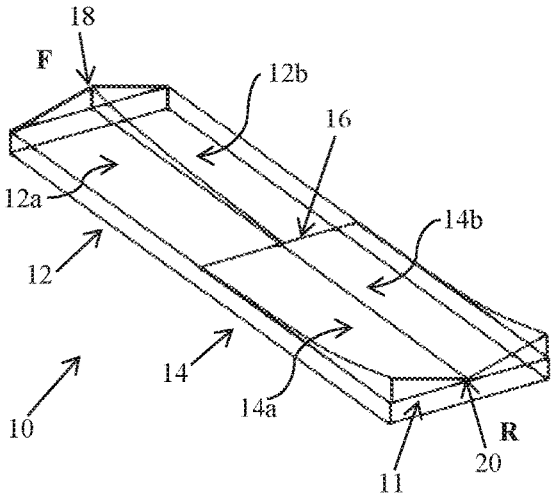
FIG. 1A shows a perspective view of a wireframe of a first embodiment of a treadmill deck or board according to the present invention.

Referring firstly to FIG. 1A, a treadmill deck (or board) is indicated generally at 10. The deck 10 is adapted to fit under a treadmill belt (not shown). The deck 10 can constructed of any suitable material. For example, the deck may be made of MDF or preferably plyboard, or a dense foam-based material (particularly for running) such as high density foam, or another material, such as a composite material, that may for example be moulded into shape. Using a foam-based material reduces heating of the treadmill belt during use. In this embodiment, the deck 10 may have a length and width corresponding to the length and width of the upper surface of a treadmill belt. In some other embodiments, the deck may be about 400 mm wide. Most treadmill belts are about 500 mm wide, so this provides 50 mm on either side as space for retrofitting and may contribute to belt stability when passing over the deck 10.

In this embodiment, the deck 10 is substantially symmetric about a central vertical longitudinal plane bisecting the deck 10. The deck 10 includes a substantially flat or planar base.

The deck 10 includes an elongate body 11. An upper surface of the deck 10 includes a foot strike area 12. The foot strike area 12 is provided in the front half of the deck 10. The foot strike area includes a left strike area or quadrant 12*a* and a right strike area or quadrant 12*b*. Each of the left and right strike areas 12*a*, 12*b* includes an outward lateral slope, providing a lateral gradient across each area. The foot strike area 12 is an inverted V-shape or convex as a result.

In this embodiment, each of the left and right strike areas 12*a*, 12*b* also includes a longitudinal slope, providing a longitudinal gradient along each area. This means that each foot strike area 12*a*, 12*b* generally decreases in height from the front end F of the deck 10 towards the middle of the deck 10.

Overall, the left strike area 12*a* includes a curved slope. The curved slope leads from the middle of the front end of the deck to the left side of the middle of the deck 10. Similarly, the right strike area 12*b* includes a curved slope. That curved slope leads from the middle of the front end of the deck to the right side of the middle of the deck 10. The outward slopes meet at a watershed 18 in the middle of the front end.

The deck 10 also includes a foot take-off area 14, provided in the rear half of the deck 10. The foot take-off area includes a left take-off area or quadrant 14*a* and a right take-off area or quadrant 14*b*. Each of the left and right take-off areas 14*a*, 14*b* includes an inward lateral slope, providing a lateral gradient across each area. The foot take-off area 14 is V-shaped or concave as a result.

The left take-off area 14*a* is disposed in-line behind the left strike area 12*a*. The right take-off area 14*b* is disposed in-line behind the right strike area 12*b*.

In this embodiment, each of the left and right take-off areas 12*a*, 12*b* also includes a longitudinal slope, providing a longitudinal gradient along each area. This means that each foot take-off area 14*a*, 14*b* generally decreases in height from the rear end R of the deck 10 towards the middle of the deck 10.

Overall, the left take-off area 14*a* includes a curved longitudinal slope (but not curved laterally—the lateral gradient is constant). The curved slope leads from the rear end of the deck to the middle of the upper surface of the deck. Similarly, the right take-off area 14*b* includes a curved longitudinal slope (but not curved laterally—the lateral gradient is constant). That curved slope leads from the rear end of the deck to the middle of the upper surface of the deck 10. The inward slopes meet at a valley 20 in the middle of the rear end.

The strike and/or take-off areas of the deck are substantially rigid, although there may be some flex when stood on, walked on or run on during use.

Figure 10:
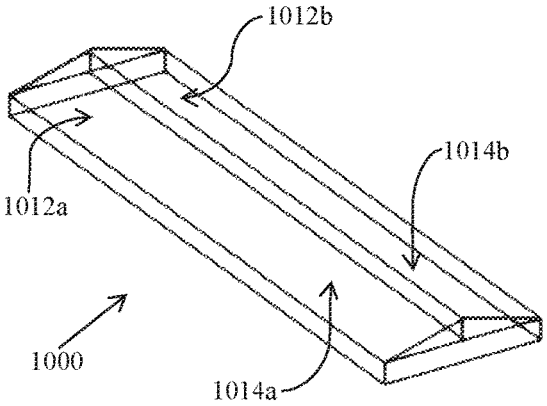
FIG. 10 shows a perspective view of a wireframe of an eleventh embodiment of a treadmill deck or board according to the present invention.

FIG. 10 illustrates the outward lateral slopes at the front end. FIG. 1D illustrates the outward lateral slopes at a section inward of the front end. The vertical height of the slopes (from the highest point to the lowest point) varies by 25 mm in FIG. 10, and by 5 mm in FIG. 1D. The slope angle $\alpha$ is about 7 degrees in FIG. 10, and the slope angle $\beta$ is about 1 degree in FIG. 1D.

Figure 1B:
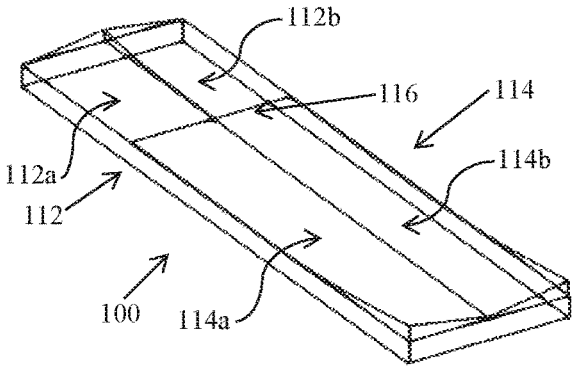
FIG. 1B shows a perspective view of a wireframe of a second embodiment of a treadmill deck or board according to the present invention.
Figure 1C:
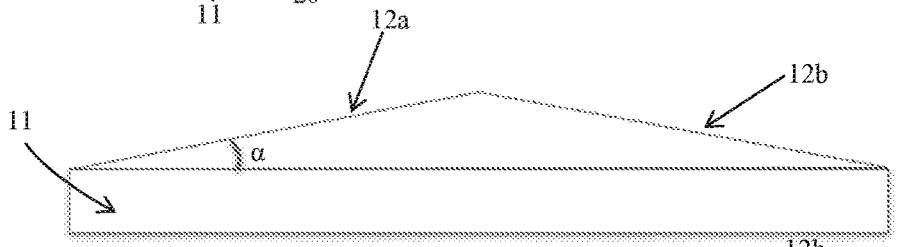
FIGS. 1C to 1G show cross-sectional views through the treadmill deck or board of FIG. 1B, at positions respectively corresponding to the front end; partway between the front end and the middle of the device; the middle of the device; partway between middle of the device and the rear end; and at the rear end.
Figure 1D:
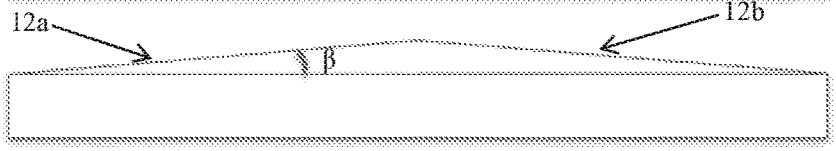
Figure 1E:
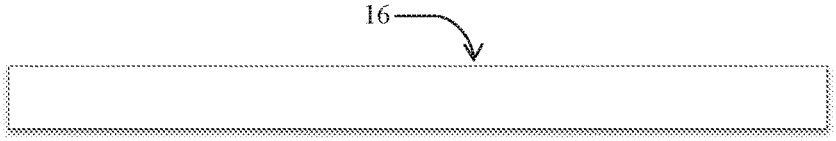
Figure 1F:
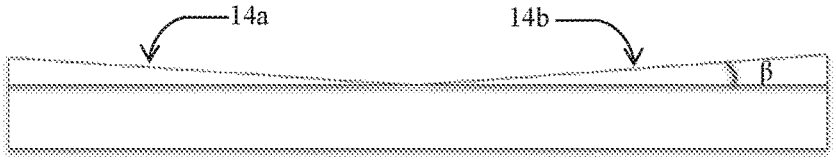
Figure 1G:
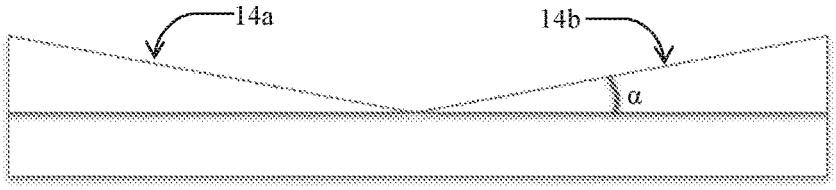

Similarly, FIG. 1G illustrates the inward lateral slopes at the rear end. FIG. 1F illustrates the inward lateral slopes at a section inward of the rear end. The vertical height of the slopes (from the highest point to the lowest point) varies by 25 mm in FIG. 1G, and by 5 mm in FIG. 1F. The slope angle $\alpha$ is about 7 degrees in FIG. 1G, and the slope angle $\beta$ is about 1 degree in FIG. 1F.

It will be appreciated that for a wider deck, with the same vertical height difference, the angles will be correspondingly lower. However, the vertical height difference in the lateral slope and the width of the deck can be selected to provide customised lateral slope angles in any embodiment.

In this embodiment, the difference in deck height between the highest and lowest points in any individual quadrant is 25 mm. It will be appreciated that the curved nature of the combined lateral and longitudinal gradients means that the change in lateral or longitudinal gradient may not be constant when considering either type of gradient individually.

The upper surface of the deck 10 includes a laterally horizontal region 16. FIG. 1E illustrates the laterally horizontal region 16. The laterally horizontal region 16 is equidistant from the front and rear ends of the deck 10 in this embodiment. The laterally horizontal region 16 delineates a boundary between the foot strike areas 12*a*, 12*b* from the respective foot take-off areas 14*a*, 14*b*. In this embodiment, the laterally horizontal region 16 constitutes an inflection where the outward slope of the strike area transitions into the inward slope of the take-off area.

Together, the left strike and take-off areas 12*a*, 14*a* provide a twisted surface for use by a left foot of a walker. Together, the right strike and take-off areas 12*b*, 14*b* provide a twisted surface for use by a right foot of a walker. The surfaces have opposing twists, or, put another way, the surfaces have opposite senses of rotation.

In this embodiment, the twisted surfaces have the same rate of change of slope angle along the deck 10. That is, the twisted surfaces substantially mirror each other about a vertical central longitudinal plane between the left- and right-hand sides of the deck 10.

It will be appreciated that the foot strike areas are regions in which a person's foot may land when using a treadmill which includes the deck 10. However, there will be variations in where the foot will land. It is much more likely that the user's foot will land in or near the middle of the relevant area than at the sides or at the front end itself.

Similarly, it will be appreciated that the foot take-off areas are regions in which a person's foot may propel from when using a treadmill which includes the deck 10. There will be variations in where the foot propels from. However, it is much more likely that the user's foot will propel from near the middle of the relevant area than from the sides or from the rear end itself.

The slope angles in the middle of the strike and take-off regions (away from the periphery of the deck 10) are therefore considered to be of greater importance, for the purposes of correcting posture when walking, than slopes angles at the periphery of the upper surface.

The deck 10 can be considered as an exercise board, if used independently of a treadmill. The exercise board 10 includes a flat base (not visible) and can be placed on a relatively flat level surface. An athlete can then stand on the front end area (or the rear end area). They can perform warm-up exercises, such as jumping or skipping, on that area. This can help to prepare particular muscles for more intense exercise or competition.

FIGS. 1A and 1C to 1G represent one embodiment of the deck 10. Various different embodiments of the deck are contemplated for different purposes, such as use in correcting different postural imbalances. Selected embodiments are discussed below with respect to FIGS. 2 to 11. Like reference numerals are used for like features.

Note that certain features of the foot strike or take-off areas may be the same as, or similar to, the equivalent areas already described with respect to FIG. 1A et al. Therefore, the description of relevant features has mainly been focused on discussion of new features, but it will be appreciated that features shown and described for FIG. 1A may also be applicable to some of the following figures, even if not replicated verbatim for brevity. For example, FIGS. 2 to 6 all include longitudinal gradients in the respective strike and take-off areas.

The orientation of the boards in FIGS. 2 to 10 is the same as in FIG. 1A, so the front end of the board is in the upper left and the rear end of the board is in the lower right of each figure as viewed on the page. It will also be apparent from viewing the Figures that the increase in slope angle, whether lateral or longitudinal, is gradual and tends to begin increasing more significantly for a given strike or take-off area around halfway between the middle of the deck and the respective deck end.

FIG. 1B illustrates a deck 100 like that of FIG. 1A. However, the deck 100 is in this case a running deck, rather than a walking deck 10. In other words, the deck 100 can be run on, as part of a treadmill, without the risk of injury that would be associated with running on the deck 10 of FIG. 1A. The lateral and longitudinal slopes (and gradients) in each strike and take-off area 112*a*, 112*b*, 114*a*, 114*b* are all shallower than the corresponding slopes than the deck 10 in FIG. 1A. The vertical height difference between maxima and minima in each quadrant is around half that of the difference in FIG. 1A.

In FIG. 1B, a laterally horizontal region 116 is provided near the front end of the deck 10'. Providing the laterally horizontal region or inflection in a forward position shortens the sloped length of the foot strike area 112, making it more suitable for jogging or running on. The foot take-off area 114 is correspondingly longer, to join up with the foot strike area 112. It will be appreciated that the region 116 could be lengthened to provide an area that is laterally horizontal, prior to transitioning into the sloped foot take-off area 114.

Figure 2:
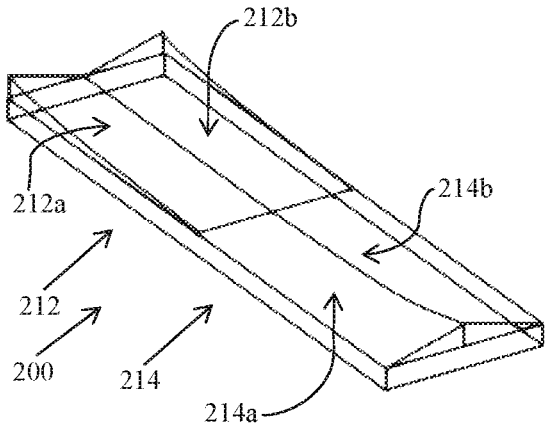
FIG. 2 shows a perspective view of a wireframe of a third embodiment of a treadmill deck or board according to the present invention.

FIG. 2 shows another treadmill deck (or exercise board), indicated generally at 200. In this embodiment, the left and right strike areas 212*a*, 212*b* include inward lateral slopes, and the left and right take-off areas 214*a*, 214*b* include outward lateral slopes.

Longitudinal gradients are provided in each slope, such that the slopes all have a slope component which is angled towards a lateral centreline of the deck 200. The strike area slopes lead from respective left and right corners of the front end of the deck to the middle of the upper surface of the deck. Similarly, the take-off area slopes lead from the middle of the rear end of the deck to respective sides at the middle of the deck 200.

It will be appreciated that this deck 200 is equivalent to a 180 degree rotation of the deck 10 in FIG. 1A about a central vertical axis.

Figure 3:
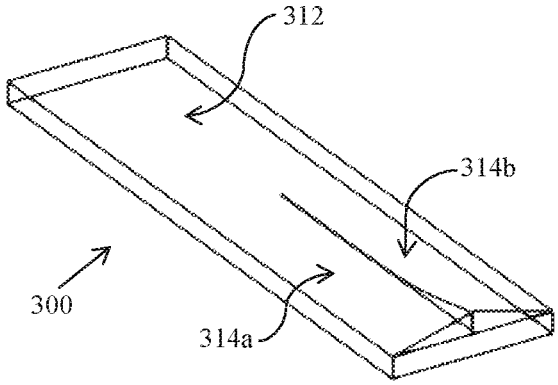
FIG. 3 shows a perspective view of a wireframe of a fourth embodiment of a treadmill deck or board according to the present invention.

FIG. 3 shows another treadmill deck (or exercise board), indicated generally at 300. The foot take-off area 314 towards the rear end of the deck 300 is the same as that of the deck 200 in FIG. 2, providing lateral outward slopes for propelling off. However, the foot strike area 312 does not include sloped left and right areas. A laterally horizontal surface 312 is instead provided for foot strikes. The surface 312 transitions into the foot take-off area 314 towards the rear end.

Figure 6:
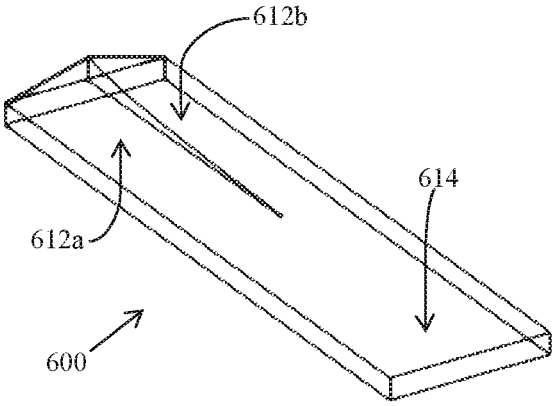
FIG. 6 shows a perspective view of a wireframe of a seventh embodiment of a treadmill deck or board according to the present invention.

FIG. 6 shows a similar treadmill deck (or exercise board) 600 to the deck 300 of FIG. 3, except that the foot take-off area 614 includes a laterally horizontal surface, and the foot strike area 612 includes lateral outward slopes. It will be appreciated that this deck 600 is equivalent to a 180 degree rotation of the deck 300 in FIG. 3 about a central vertical axis.

Figure 13:
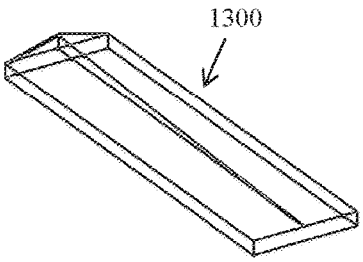
FIG. 13 shows a perspective view of a wireframe of a fourteenth embodiment of a treadmill deck or board according to the present invention.

FIG. 13 shows a similar treadmill deck (or exercise board) 1300 to the deck 600 of FIG. 6, except that the foot strike and take-off areas both include outward slopes. The magnitude of the lateral gradient is lower in the take-off area compared to the strike area. There is a lateral gradient across the deck at substantially any position along the length of the deck on the right or left portions. It will be appreciated that the deck could be turned around so that the more highly sloped sections are in the take-off area, and the shallower lateral gradient sections are in the strike area.

Figure 4:
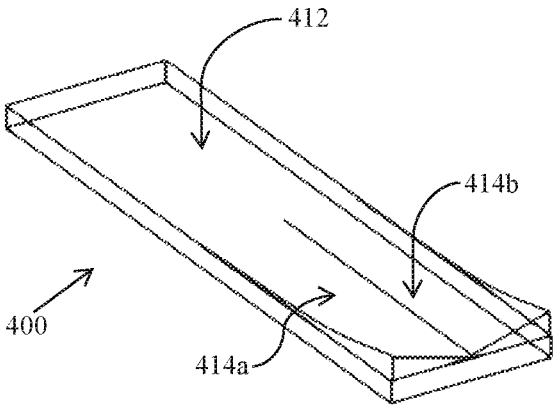
FIG. 4 shows a perspective view of a wireframe of a fifth embodiment of a treadmill deck or board according to the present invention.

FIG. 4 shows another treadmill deck (or exercise board), indicated generally at 400. The foot take-off area 414 towards the rear end of the deck 300 is the same as that of the deck 10 in FIG. 1A, providing lateral inward slopes for propelling off. However, the foot strike area 412 does not include sloped left and right areas. A laterally horizontal surface 412 is instead provided for foot strikes. The surface 412 transitions into the foot take-off area 414 towards the rear end.

Figure 5:
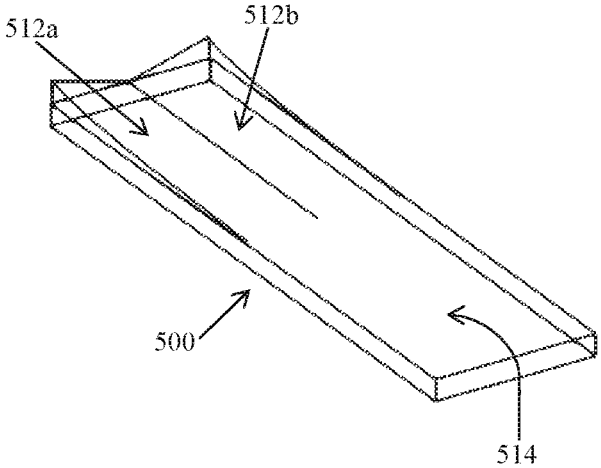
FIG. 5 shows a perspective view of a wireframe of a sixth embodiment of a treadmill deck or board according to the present invention.

FIG. 5 shows a similar treadmill deck (or exercise board) 500 to the deck 400 of FIG. 4, except that the foot take-off area 514 includes a laterally horizontal surface, and the foot strike area 512 includes lateral inward slopes. It will be appreciated that this deck 500 is equivalent to a 180 degree rotation of the deck 400 in FIG. 4 about a central vertical axis.

Figure 12:
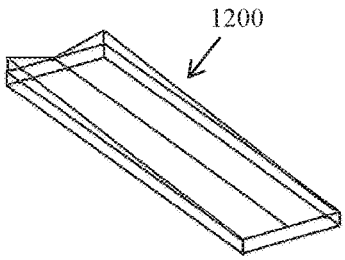
FIG. 12 shows a perspective view of a wireframe of a thirteenth embodiment of a treadmill deck or board according to the present invention.

FIG. 12 shows a similar treadmill deck (or exercise board) 1200 to the deck 500 of FIG. 5, except that the foot strike and take-off areas both include inward slopes. The magnitude of the lateral gradient is lower in the take-off area compared to the strike area. There is a lateral gradient across the deck at substantially any position along the length of the deck on the right or left portions. It will be appreciated that the deck could be turned around so that the more highly sloped sections are in the take-off area, and the shallower lateral gradient sections are in the strike area.

Figure 7:
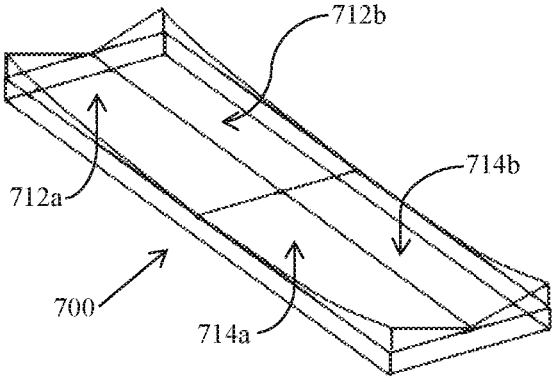
FIG. 7 shows a perspective view of a wireframe of an eighth embodiment of a treadmill deck or board according to the present invention.

FIG. 7 shows another treadmill deck (or exercise board), indicated generally at 700. In this embodiment both of the strike and take-off areas 712, 714 have lateral inward slopes.

Whilst the slope angle (and rate of change of slope angle) is the same in both strike and take-off areas, it will be appreciated that other embodiments may include differing slope angles (and rates of change of slope angle) between the left and right sides, and/or between the strike and take-off areas. The same caveat applies for any embodiment of the treadmill deck.

Figure 8:
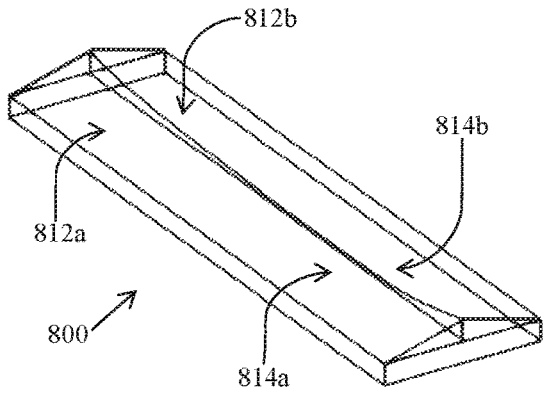
FIG. 8 shows a perspective view of a wireframe of a ninth embodiment of a treadmill deck or board according to the present invention.

FIG. 8 shows another treadmill deck (or exercise board), indicated generally at 800. In this embodiment both of the strike and take-off areas 812, 814 have lateral outward slopes. The centre of the upper surface of the deck may be a saddle point in some embodiments according to variations of this configuration of slopes.

Figure 9:
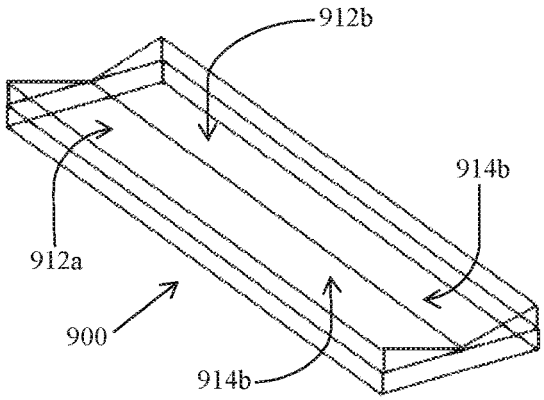
FIG. 9 shows a perspective view of a wireframe of a tenth embodiment of a treadmill deck or board according to the present invention.

FIG. 9 shows another treadmill deck (or exercise board), indicated generally at 900. In this embodiment, the left foot strike and take-off areas 912*a*, 914*a* include a lateral inward slope provided by a single planar surface, without a longitudinal slope component. The same applies to the right strike and take-off areas 912*b*, 914*b*.

FIG. 10 shows another treadmill deck (or exercise board), indicated generally at 1000. In this embodiment, the left foot strike and take-off areas 1012*a*, 1014*a* include a lateral outward slope provided by a single planar surface, without a longitudinal slope component. The same applies to the right strike and take-off areas 1012*b*, 1014*b*.

Figure 11:
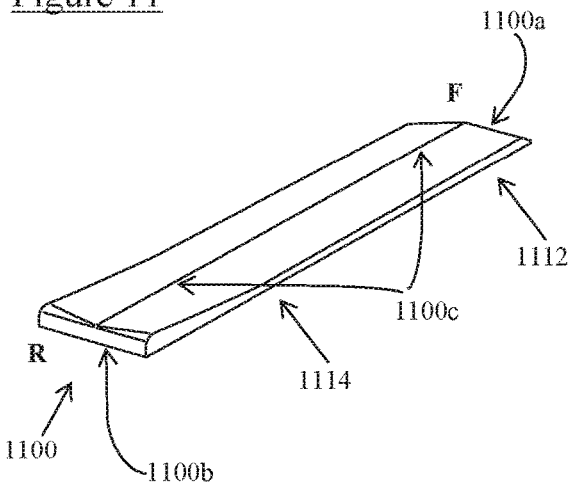
FIG. 11 shows a perspective view of a wireframe of a twelfth embodiment of a treadmill deck or board according to the present invention.

FIG. 11 shows another treadmill deck (or exercise board), indicated generally at 1100. The deck 1100 is similar to the deck in FIG. 1A. A foot strike area 1112 with lateral outward slopes is provided at the front end F, and a foot take-off area 1114 with lateral inward slopes is provided at the rear end R. It can be seen that the deck 1100 has rounded front and rear ends 1100*a*, 1100*b* for minimising treadmill belt wear during use. A central ridge 1100*c* between the left and right hand sides is rounded too.

Figure 14:
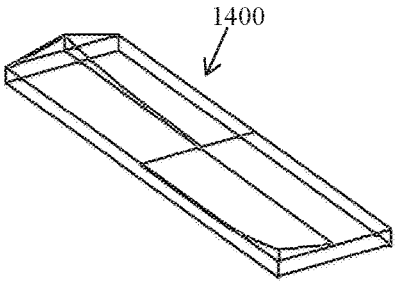
FIG. 14 a perspective view of a wireframe of a fifteenth embodiment of a treadmill deck or board according to the present invention.

FIG. 14 shows another treadmill deck (or exercise board), indicated generally at 1400. The deck 1100 is similar to the deck in FIG. 1A. However, in this case, one of the foot take-off quadrants is provided with a laterally horizontal surface, whilst the other foot take-off quadrant is sloped. Other embodiments may provide one, two or three quadrants of the strike and take-off areas with laterally horizontal surfaces, whilst three, two or one of the remaining quadrants of the strike and take-off areas include inward and/or outward slopes.

In some embodiments, the treadmill deck can be installed as part of a treadmill. This can be done during initial manufacture of a treadmill, or the deck can be retrofitted to a treadmill. The treadmill belt runs over the upper surface of the deck during use. When a person walks (or runs) on the belt and deck, their foot is (or feet are) modulated in at least a lateral direction during the strike and/or propulsion phases of the gait cycle, or when striking or taking off from a stationary position (e.g. on an exercise board). This rolling of the foot contributes to improved posture after even short periods of use of the treadmill. Comparable benefits may be obtained by using the deck alone as a surface on which to jump or stand whilst doing other exercises.

It will be appreciated that the above embodiments are examples only and that many other embodiments are contemplated within the scope of the claims. For example, the foot strike area and/or the foot take-off area may be less than half the length of the deck. The remaining area between those areas may include a horizontal surface (when the deck is provided on a flat and level surface), which could be part of the deck or could be provided by another item (such as a deck already installed in a treadmill).

The embodiments of the deck shown are generally suitable for supporting all of the upper portion of a treadmill belt, that is the portion which is available to be walked or run on at a given time during use. However, the length or width of the deck may be less than that of the treadmill belt, and so only support part of the belt, if suitable support for the rest of the belt is provided by another suitable body arranged next to the deck. This may be appropriate where the deck only comprising a foot strike area, or only comprises a foot take-off area, or only comprises left strike and take-off areas, or only comprises right strike and take-off areas, for example.

The embodiments described above are provided by way of example only, and various changes and modifications will be apparent to persons skilled in the art without departing from the scope of the present invention as defined by the appended claims.

The invention claimed is:

1. A treadmill deck for supporting at least part of a treadmill belt, the treadmill deck comprising a foot strike area disposed towards one end of the treadmill deck, and a foot take-off area disposed towards another end of the treadmill deck, a first upper surface of one of the foot strike area and the foot take-off area including: a first lateral inward slope or a first lateral outward slope, which provides a first lateral gradient across at least part of the one of the foot strike area and the foot take-off area, and a second upper surface of the other of the foot strike area and the foot take-off area including one of: a laterally horizontal surface or a second lateral inward slope or a second lateral outward slope, in which where one of the second lateral inward slope or the second lateral outward slope provides a second lateral gradient across at least part of the other of the foot strike area and the foot take-off area, in which the treadmill deck comprises one or both of:

only one of the foot strike area and the foot take-off area includes the first or second lateral inward slope, or only one of the foot strike area and the foot take-off area includes the first or second lateral outward slope; and the foot strike area is connected to the foot take-off area by a substantially horizontal region or inflection of the treadmill deck;

in which the treadmill deck has a fixed upper surface, wherein the first upper surface is provided by a first portion of the fixed upper surface, and the second upper surface is provided by a second portion of the fixed upper surface.

2. The treadmill deck as claimed in claim 1, in which the treadmill deck includes a left half for a left foot and a right half for a right foot, and one or both of: the foot strike area includes a first left portion and a first right portion in the respective halves and the foot take-off area includes a second left portion and a second right portion in the respective halves, wherein the treadmill deck comprises one or both of: the first left portion and first right portion of the foot strike area have opposing lateral gradients, and the second left portion and second right portion of the foot take-off area have opposing lateral gradients.

3. The treadmill deck as claimed in claim 2, in which the left portion and the right portion of one of the foot strike area and the foot take-off area together provide a substantially convex or inverted V-shaped surface.

4. The treadmill deck as claimed in claim 2, in which the left portion and the right portion of one of the foot take-off area and the foot strike area together provide a substantially concave or V-shaped surface.

5. A The treadmill deck as claimed in claim 2, in which one or both of the foot strike area and the foot take-off area provide twisted surfaces along each of the left half of the treadmill deck and the right half of the treadmill deck.

6. The treadmill deck as claimed in claim 1, in which the treadmill deck includes a base comprising a grippy or tacky surface for engaging a treadmill surface to maintain the treadmill deck in position under the treadmill belt during use.

7. The treadmill deck as claimed in claim 1, in which one or both of the first and second upper surfaces includes a longitudinal slope which provides a longitudinal gradient along at least part of the one or both of the foot strike area and foot take-off area.

8. The treadmill deck as claimed in claim 1, in which the treadmill deck comprises one or both of:

a first magnitude of the lateral gradient of the foot strike area decreases from a near end of the treadmill deck towards the foot take-off area, and a second magnitude of the lateral gradient of the foot take-off area decreases from a near end of the treadmill deck towards the foot strike area.

9. The treadmill deck as claimed in claim 1, in which the treadmill deck is in the form of a unitary body.

10. The treadmill deck as claimed in claim 1, in which, when the horizontal area or inflection is provided, the foot strike area transitions into the horizontal area or inflection in a region disposed in a front half of the treadmill deck.

11. The treadmill deck as claimed in claim 1, in which the foot strike area includes the first lateral inward slope, and the foot take-off area includes the laterally horizontal surface or the second lateral outward slope.

12. The treadmill deck as claimed in claim 1, in which the foot strike area includes the first lateral outward slope, and the foot take-off area includes the laterally horizontal surface or the second lateral inward slope.

13. A The treadmill deck as claimed in claim 1, in which the foot strike area includes the laterally horizontal surface, and the foot take-off area includes the first lateral inward slope or the first lateral outward slope.

14. The treadmill deck as claimed in claim 1, in which one or both of the foot strike area and the foot take-off area provide a twisted surface along the treadmill deck for walking or running on.

15. The treadmill deck as claimed in claim 1, fitted to a treadmill or provided as part of a kit for fitting to a treadmill.

16. A treadmill deck for supporting at least part of a treadmill belt, the treadmill deck having a fixed upper surface comprising a foot strike area or a foot take-off area disposed at or towards one end of the treadmill deck, the foot strike area or the foot take-off area transitioning into a laterally horizontal surface in a direction away from the end of the treadmill deck, the foot strike area or the foot take-off area including a left region for a left foot and a right region for a right foot, in which the treadmill deck comprises one or both of:

a first upper surface of the left region is provided by a first portion of the fixed upper surface and includes a first lateral inward slope or a first lateral outward slope which provides a first lateral gradient across at least part of the left region, and a second upper surface of the right region is provided by a second portion of the fixed upper surface and includes a second lateral inward slope or a second lateral outward slope which provides a second lateral gradient across at least part of the right region.

17. The treadmill deck as claimed in claim 16, fitted to a treadmill.

18. A kit for replacing or modifying an existing treadmill deck in a treadmill, the kit comprising a retrofittable treadmill deck for installation on or in place of the existing treadmill deck to support at least part of a treadmill belt, the retrofittable treadmill deck having a fixed upper surface comprising a foot strike area or a foot take-off area disposed at or towards one end of the retrofittable treadmill deck, the foot strike area or the foot take-off area transitioning into a laterally horizontal surface in a direction away from the end of the retrofittable treadmill deck, the foot strike area or the foot take-off area including a left region for a left foot and a right region for a right foot, in which the retrofittable treadmill deck comprises one or both of:

a first upper surface of the left region is provided by a first portion of the fixed upper surface and includes a first lateral inward slope or a first lateral outward slope which provides a first lateral gradient across at least part of the left region, and a second upper surface of the right region is provided by a second portion of the fixed upper surface and includes a second lateral inward slope or a second lateral outward slope which provides a second lateral gradient across at least part of the right region.

19. The kit as claimed claim 18, retrofitted to the treadmill.

* * * * *